US009533339B2

(12) United States Patent
Kamp et al.

(10) Patent No.: US 9,533,339 B2
(45) Date of Patent: Jan. 3, 2017

(54) METHOD OF PRODUCING A SHAPED AL ALLOY PANEL FOR AEROSPACE APPLICATIONS

(75) Inventors: Arjen Kamp, Leiden (NL); Sabine Maria Spangel, Koblenz (DE)

(73) Assignee: ALERIS ROLLED PRODUCTS GERMANY GMBH, Koblenz (DE)

( * ) Notice: Subject to any disclaimer, the term of this patent is extended or adjusted under 35 U.S.C. 154(b) by 684 days.

(21) Appl. No.: 13/993,018

(22) PCT Filed: Oct. 28, 2011

(86) PCT No.: PCT/EP2011/068966

§ 371 (c)(1),
(2), (4) Date: Jul. 3, 2013

(87) PCT Pub. No.: WO2012/079828

PCT Pub. Date: Jun. 21, 2012

(65) Prior Publication Data

US 2013/0312881 A1 Nov. 28, 2013

(30) Foreign Application Priority Data

Dec. 15, 2010 (EP) ..... 10195118

(51) Int. Cl.
*C22F 1/047* (2006.01)
*B21D 25/00* (2006.01)
*C22C 21/06* (2006.01)

(52) U.S. Cl.
CPC ..... *B21D 25/00* (2013.01); *C22C 21/06* (2013.01); *C22F 1/047* (2013.01)

(58) Field of Classification Search
CPC ..... C22C 21/06; C22F 1/047; B21D 25/00
USPC ..... 148/696
See application file for complete search history.

(56) References Cited

U.S. PATENT DOCUMENTS 4,083,220 A 4/1978 Kobayashi et al.
4,159,217 A 6/1979 Selines et al.
6,139,653 A 10/2000 Fernandes et al.
(Continued)

FOREIGN PATENT DOCUMENTS

CA 2091035 A1 9/1993
CA 2091035 A1 9/1998
(Continued)

OTHER PUBLICATIONS

International Alloy Designations and Chemical Composition Limits for Wrought Aluminum and Wrought Aluminum Alloys, The Aluminum Association (2009).
(Continued)

*Primary Examiner* — Jie Yang
(74) *Attorney, Agent, or Firm* — Vorys, Sater, Seymour and Pease LLP

(57) ABSTRACT

A method of producing a shaped aluminum alloy panel, preferably for aerospace or automotive applications, from 5000-series alloy sheet. The method includes: providing a sheet made of 5000-series alloy having a thickness of about 0.05 to 10 mm and a length in the longest dimension of at least 800 mm; and stretch forming the sheet at a forming temperature between −100° C. and −25° C., to obtain a shaped aluminum alloy panel. A shaped article formed by the above method is also provided.

27 Claims, 11 Drawing Sheets

(56) References Cited

U.S. PATENT DOCUMENTS

| | | | | |
|---|---|---|---|---|
| 8,051,696 | B2 * | 11/2011 | Yoshida | B21D 22/22 72/347 |
| 9,039,848 | B2 * | 5/2015 | Norman | C22C 21/06 148/552 |

FOREIGN PATENT DOCUMENTS

| | | | |
|---|---|---|---|
| CN | 101880802 | A | 11/2010 |
| FR | 2688153 | A1 | 9/1993 |
| JP | H05-247480 | A | 9/1993 |
| WO | 9835068 | A1 | 8/1998 |

OTHER PUBLICATIONS

International Search Report dated Dec. 15, 2011 from PCT/EP2011/068966 to Kamp et al. filed Oct. 28, 2011.
Written Opinion dated Dec. 15, 2011 from PCT/EP2011/068966 to Kamp et al. filed Oct. 28, 2011.
International Preliminary Report on Patentability of Jun. 27, 2013 for PCT International Application No. PCT/EP2011/168966, International Filing Date Oct. 28, 2011.

* cited by examiner

METHOD OF PRODUCING A SHAPED AL ALLOY PANEL FOR AEROSPACE APPLICATIONS

CROSS-REFERENCE TO RELATED APPLICATIONS

This is a §371 National Stage Application of International Application No. PCT/EP2011/068966 filed on 28 Oct. 2011, claiming the priority of European Patent Application No. 10195118.4 filed on 15 Dec. 2010.

FIELD OF THE INVENTION

The invention relates to a method of producing a shaped aluminium alloy panel, preferably for aerospace or automotive applications, from 5000-series aluminium alloy sheet.

BACKGROUND OF THE INVENTION

As will be appreciated herein below, except as otherwise indicated, alloy designations and temper designations refer to the Aluminum Association designations in Aluminum Standards and Data and the Registration Records, as published by the Aluminum Association in 2010 as is well known in the art.

For any description of alloy compositions or preferred alloy compositions, all references to percentages are by weight percent unless otherwise indicated.

AlMg alloys, and in particular AlMgSc alloys, are suitable candidates for aerospace applications due to their low density compared to various existing aluminium alloys, while at the same time the strength and toughness level are comparable. However, the aerospace applications require the sheet to be formed to complex curved shapes, such as fuselage skin, lower wing skin, upper wing skin or wing stringers. Currently, creep forming is the preferred method for forming aluminium alloy sheet of the 5000-series. During creep forming, the sheet is heated in an autoclave to a temperature typically above about 300° C., and a load is applied to the sheet, for example by using a vacuum to draw the sheet into the mould. During the process, the sheet slowly deforms to the desired shape, and which may take several hours. The main advantage of this forming process is the high shape accuracy, and that it can be combined with laser beam welding of the stringers to the sheet. Disadvantages are the high capital costs of the creep anneal installation, and the long forming times required.

An alternative forming process known in the art is stretch forming, in which the sheet is gripped at its margins and stretched over a mould. This forming technique is used for age-hardenable aluminium alloys in the aerospace industry. However, when using stretch forming for 5000 alloys, the Portevin-Le Chatelier ("PLC") effect results in so called PLC-bands on the formed panel. These are parallel bands appearing on the surface of the formed sheet due to an inhomogeneous flow during stretching, visible also from the serrated stress-strain curves recorded during the stretch form process. Such PLC bands are considered to be unacceptable surface defects and so far prevent the use of such panels for the aerospace industry or in automotive applications.

One possibility to prevent PLC band formation is to reduce the temperature during stretch forming to cryogenic temperatures. This method has been disclosed in patent document U.S. Pat. No. 4,159,217, where it was proposed to stretch-form a work-hardened sheet at cryogenic temperatures in the range of −100° C. to about −200° C. The sheet was cooled down by immersing in a suitable cryogenic medium such as liquid nitrogen, or in a mixture of dry ice and alcohol. However, U.S. Pat. No. 4,159,217 is silent on the tensile properties and thus the feasibility of stretch forming at low temperatures for 5000-series alloys. Furthermore, the temperatures used are very low, requiring copious use of cryogenic media.

It is therefore an object of the invention to provide a process for forming shaped aluminium alloy panels, which provides good results for 5000-series alloy sheet, and which is more cost-effective than the disclosed prior art method. In addition, it is an object of the invention to provide shaped aluminium alloy panels of the 5000 alloy series which have good combinations of elongation, tensile properties and corrosion resistance after forming.

SUMMARY OF THE INVENTION

This object and further advantages are met or exceeded by the present invention defined by the method according to claim 1 and the shaped aluminium alloy panel according to claim 11.

DETAILED DESCRIPTION OF THE INVENTION

Surprisingly, it has been found that stretch forming of 5000-series alloy sheet without the formation of PLC bands is possible at temperatures between −100° C. and −25° C. A preferred upper limit for the forming temperature is about −30° C., more preferred about −35° C., and most preferred about −40° C. A preferred lower temperature limit is about −90° C., most preferred about −80° C. For practical reasons, the forming temperature is usually chosen at the higher part of the temperature range, e.g. between about −40° C. and −70° C., allowing the alloy sheet to be cooled for example by dry ice, which has a temperature of only −78° C.

This comparatively high temperature allows more flexibility in the applied stretch forming process. For example, it is possible to cool the aluminium sheet prior to stretch forming, i.e. the stretch forming installation need not be cooled itself. Alternatively, the sheet is cooled during forming, but possibly the active cooling may be stopped during the forming process. Cooling to the forming temperature can be done by placing cold media on the sheet, such as dry ice, by spraying with liquid nitrogen, or by cooling down the stretch forming equipment by means of an ordinary cooling apparatus as used for refrigerators. According to a preferred embodiment, the sheet is cooled down prior to the stretch forming by use of dry ice, in particular by immersion in or spraying with dry ice, and no further cooling is done during the stretch forming. Thereby, forming temperatures between about −70° C. and about −40° C. can be realised, which are perfectly adequate for achieving good forming results, as will be shown below, and at the same time the cooling process is cost-effective due to the use of relatively inexpensive dry ice.

The sheet is made of 5000-series alloy, preferably of an alloy also containing Scandium in a range of 0.05 to 1%. For example, the aluminium alloy may have a composition comprising 3.0-6.0% Mg, preferably 3.8-5.3% Mg, and 0.05-0.5% Sc, preferably 0.1-0.4% Sc, most preferred 0.2-0.3% Sc. Optionally, the alloy may comprise 0.05-0.25% Zr, preferably 0.10-0.15% Zr. The balance is made by Fe, Si, regular impurities and aluminium. Optionally the aluminium alloy may contain up to 2% Zn.

In a more preferred embodiment the aluminium alloy is made from the AA5024 series.

The method is applicable to sheet material having a thickness of about 0.05-10 mm, preferably about 0.8-6 mm, and a length in the longest dimension of at least 800 mm. It is characteristic for the invention that it can be industrially applied to produce larger panels with good properties. Preferably, the alloy sheet has a length in the longest dimension of at least 1 m, preferably >3 m, and preferably the alloy sheet has a width of 0.4-2 m.

The invention is used to produce a shaped aluminium alloy panel for structural aerospace applications, wherein the shaped panel can be used as lower wing skin, upper wing skin, spar, or fuselage skin.

Generally speaking, the inventors have discovered that the critical temperature $T_{crit}$, below which no PLC bands will form on the shaped panel, is higher than one might have expected from the prior art, and is in many applications between −40 and −30° C., for example around −40° C. It has been further discovered that the critical temperature for AA5000 series aluminium alloys depends on the strain rate during forming, wherein this relationship can be characterised by the following formula:

$$T_{crit}[^\circ\text{ C.}]=\log_{10}(\acute{\epsilon}[s^{-1}])\times 18.8+13.8^\circ\text{ C.}$$

wherein $\acute{\epsilon}$ is the strain rate during forming. Surprisingly, it has been found that, the higher the strain rate, the higher the critical temperature. For example, at a strain rate of above $1\times10^{-3}$ $s^{-1}$, no PLC lines were observed at a temperature of −40° C., while at a strain rate of only about $2\times10^{-4}$ $s^{-1}$, PLC lines formed even at a temperature as low as −50° C. Thus, the above formula can be used as a helpful tool to adjust the strain rate to the available temperature, or the other way round. Since a high strain rate results in a high output, it will generally be preferable to work at a higher strain rate, in particular since it has been found that a higher strain rate does not result in considerable deterioration of tensile properties. On the contrary, samples stretched at the same temperature but at a higher strain rate showed slightly increased strength and elongation, and a higher ratio of tear strength to yield strength.

Since, in a complex-shaped article, not every part of the sheet will be strained at the same rate and with the same total strain, the values given in this application are assumed to be the average values over the shaped aluminium alloy panel, unless otherwise indicated.

The total strain is typically above 1% and below 8%, e.g. between 3% and 8%, more preferred between about 3.5% and 6.5%, and most preferred between 4% and 6%. With such strains, it can be shown that the variability in tensile values and elongation at different total strains is less than 10%, the variability between sheets stretched by 4% and 6% is even less than 8% for the tensile values, and only about 3% for elongation. This result is very good, since, of course, different parts of a shaped article will be stretched to different total strains, and this should not result in extreme variations in the properties of the shaped aluminium alloy panel. Thus, stretch forming at the temperatures according to the invention has the advantage that shaped panels of relatively uniform properties can be obtained.

Preferably, the strain rate during stretch forming is above $1\times10^{-4}$ $s^{-1}$, thus resulting in a critical temperature of above about −60° C., more preferred the strain rate is above $1\times10^{-3}$, resulting in a critical temperature about −42° C., and most preferred, the strain rate is above $2\times10^{-3}$.

Accordingly, a preferred target forming temperature is below −40° C., preferably below −50° C., but preferably above the temperature of dry ice (−78° C.). The target temperature is that which one aims at achieving during the stretch forming.

According to a preferred aspect of the invention, the temperature need not be held constant (for example at the target forming temperature) during the stretch forming step. For example, the temperature may vary by ±7° C., more preferred by ±10° C., most preferred by ±15° C.

The sheet used in the stretch forming process has preferably been processed by casting an ingot; hot rolling the ingot to an intermediate gauge, such as for example 5-10 mm; cold rolling the hot-rolled product to the final gauge, such as for example 2-6 mm, and annealing the cold-rolled product at a temperature of for example 270-280° C. for 1-2 hours.

It has been found further that work-hardening is achieved by the stretch forming according to the invention, to increase values such as the yield strength and the ultimate tensile strength by about 10-20%, preferably by at least 15%, in comparison with an unstretched reference.

According to a preferred embodiment, a post-forming annealing is carried out at a temperature between 250° C. and 350° C., preferably 275° C. to 325° C., or inter-annealing steps between two stretch forming steps also at a temperature of 250-350° C., preferably 275° C. to 325° C., in order to eliminate any remaining inhomogeneous properties, or to balance the properties to the desired application.

In another aspect, the invention is also directed to a shaped aluminium alloy panel for structural aerospace or automotive applications having been shaped by the method according to the invention. The shaped aluminium alloy panel does not show any PLC bands and has an ultimate tensile strength of above 380 MPa, preferably above 400 MPa, and an elongation above 7%, preferably above 8%. At least for structural aerospace applications, the ratio of tear strength to yield strength is preferably above 1.5, more preferred above 1.6, and the yield strength is preferably above 325 MPa, more preferred above 350 MPa. These results have been achieved at a total strain of 6% and temperatures of −40 or −50° C.

The shaped aluminium alloy panel is preferably processed according to the above-described method steps.

In preferred embodiments, the 5000-series alloy sheet is made of a Sc-containing alloy having Sc in a range of 0.05 to 1%.

BRIEF DESCRIPTION OF THE DRAWINGS

FIG. 1 summarises a number of experiments which have been carried out to find out the critical temperature, i.e. the maximum temperature below 0° C. at which 5000-series alloy sheet can be stretched without PLC lines appearing. The circular data points indicate sample with no PLC lines, square data point represent samples with PLC lines. Surprisingly, one has found a relationship between the strain rate and the temperature, which can be summarised by the formula:

$$T_{crit}[^\circ\text{ C.}]=\log_{10}(\acute{\epsilon}[s^{-1}])\times 18.8+13.8^\circ\text{ C.}$$

Figure 1:
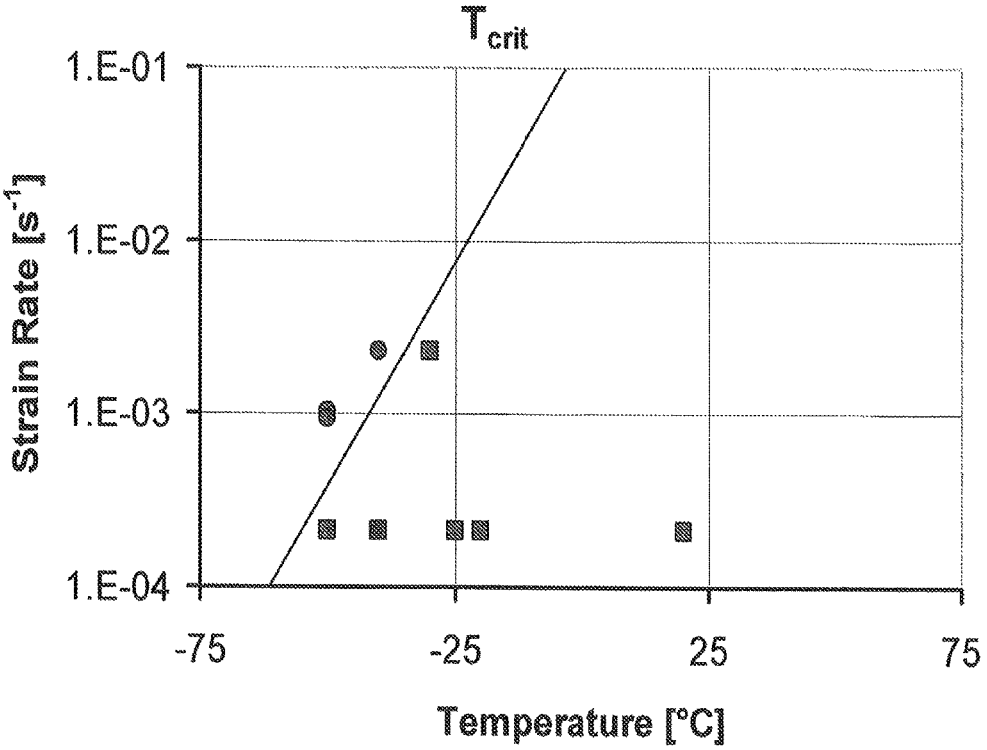
FIG. 1 is a diagram summarising the tests made at different strain rates and temperatures, indicating the appearance of PLC lines or no PLC lines.
Figure 2:
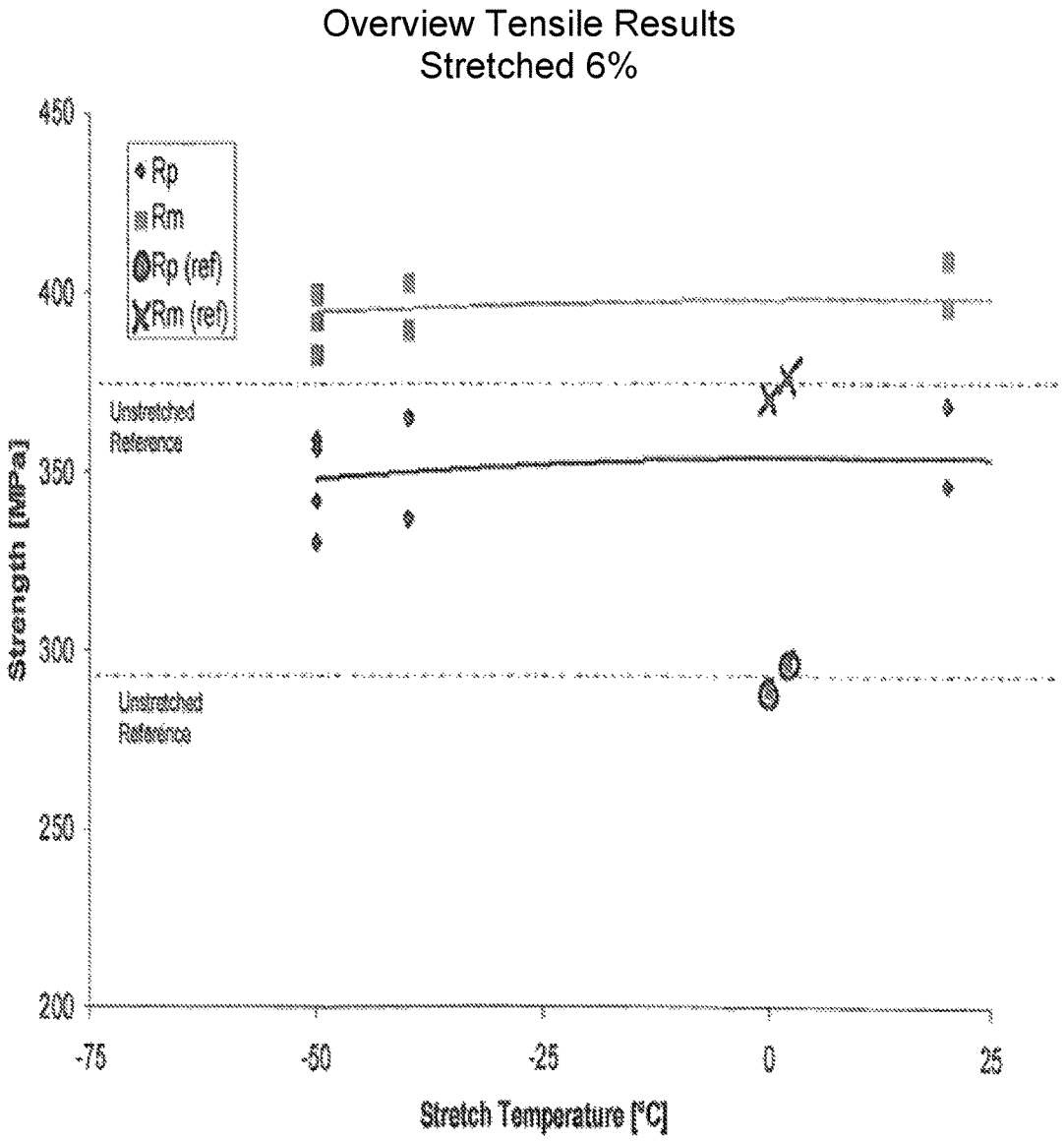
FIG. 2 is a diagram of tensile strength and yield strength of various samples stretched at different temperatures.

The critical temperature is drawn in FIG. 1 as a line separating samples with no PLC lines from those which showed PLC lines. Surprisingly, the higher the strain rate, the higher the stretching temperature can be. Thus, at the temperature range above about −100° C. and below the critical temperature, homogeneous flow occurs during stretching. Experiments show that the dislocation movement at these temperatures is rather homogeneous, because the solute atoms cannot catch up with the moving dislocations to pin them, caused by the low diffusivity of the solute Mg atoms at the low temperatures. The experiments of FIG. 1 were carried out with an AlMgSc alloy having the following composition: Mg 4.5%, Sc 0.27%, Zr 0.10%, impurities <0.05% each and <0.15% in total, remainder aluminium.

EXAMPLES

Alloys were cast, processed to sheet products and stretched at various temperatures and at various strain rates and total strains to investigate the advantages of the present invention. In particular, an alloy containing 4.5% Mg, 0.26% Sc, 0.10% Zr, impurities <0.05% each and <0.15% in total, remainder aluminium, was cast to ingots having a diameter of 262 mm and 1400 mm length. From these ingots, rolling blocks were machined with a gauge of 80 mm. The rolling blocks were hot-rolled to an intermediate gauge of 8 mm, cold rolled to a thickness of 4 mm, annealed for 1 hour at 275° C., cold rolled to 1.6 mm, and annealed for two hours at 325° C. From these cold rolled sheet, panels were machined which were subjected to a cryogenic stretching operation at various temperatures, strain rates and total strains, as indicated in the below tables 1 and 2.

Tensile properties were tested according to DIN EN-10.002. In tables 1 and 2, Rp stands for the yield strengths, Rm for the ultimate tensile strength, and A stands for elongation. "TS" stands for tear strength and was measured in L-T and T-L direction according to ASTM-B871-96. "UPE" stands for "unit propagation energy" and was also measured according to ASTM-B871-96. It is a measure for the propagation of cracks, while TS is indicative of the amount of crack formation.

TABLE 1

Summary of tear strength TS, UPE and TS/Rp for 8 samples of the same sheet, but stretched at different temperatures, strain rates and total strain.

| Sample | Forming temperature | Strain Rate | Strain | TS | | UPE | | TS/Rp |
|---|---|---|---|---|---|---|---|---|
| ID | [° C.] | [s−1] | [%] | L-T | T-L | L-T | T-L | L-T |
| 1 | −50 | 1.3E−03 | 6 | 583 | 560 | 101 | 122 | 1.62 |
| 2 | −50 | 9.3E−04 | 6 | 546 | 571 | 88 | 140 | 1.53 |
| 3 | −50 | 1.0E−03 | 4 | 554 | 580 | 126 | 159 | 1.68 |

TABLE 1-continued

Summary of tear strength TS, UPE and TS/Rp for 8 samples of the same sheet, but stretched at different temperatures, strain rates and total strain.

| Sample | Forming temperature | Strain Rate | Strain | TS | | UPE | | TS/Rp |
|---|---|---|---|---|---|---|---|---|
| ID | [° C.] | [s−1] | [%] | L-T | T-L | L-T | T-L | L-T |
| 4 | −50 | 2.0E−04 | 4 | 539 | 561 | 129 | 126 | 1.58 |
| 5 | −40 | 2.3E−03 | 6 | 576 | 577 | 96 | 119 | 1.58 |
| 6 | −40 | 1.9E−04 | 4 | 573 | 577 | 136 | 137 | 1.70 |
| 7 | 20 | 2.6E−04 | 6 | 537 | 557 | 149 | 79 | 1.46 |
| 8 | 20 | 2.6E−04 | 4 | 547 | 549 | 112 | 172 | 1.58 |

Table 1: Summary of tear strength TS, UPE and TS/Rp for 8 samples of the same sheet, but stretched at different temperatures, strain rates and total strain.

TABLE 2

Tensile values for 8 different samples of sheet stretched at various temperatures, strain rates and total strains.

| Sample ID | Temperature [° C.] | Strain Rate [s−1] | Strain [%] | Rp [MPa] | Rm [MPa] | Ag [%] | A [%] | PLC Lines |
|---|---|---|---|---|---|---|---|---|
| 1 | −50 | 1.3E−03 | 6 | 359 | 400 | 8.0 | 9.2 | No |
| 2 | −50 | 9.3E−04 | 6 | 357 | 400 | 8.1 | 9.2 | No |
| 3 | −50 | 1.0E−03 | 4 | 330 | 383 | 11.8 | 12.6 | No |
| 4 | −50 | 2.0E−04 | 4 | 342 | 393 | 9.2 | 10.5 | No |
| 5 | −40 | 2.3E−03 | 6 | 365 | 403 | 6.8 | 7.0 | No |
| 6 | −40 | 1.9E−04 | 4 | 337 | 390 | 9.1 | 9.6 | No |
| 7 | 20 | 2.6E−04 | 6 | 369 | 410 | 8.2 | 8.8 | YES |
| 8 | 20 | 2.6E−04 | 4 | 347 | 397 | 9.9 | 10.7 | YES |
| Base | — | — | 0 | 293 | 374 | 11.7 | 13.0 | No |

Table 2: Tensile values for 8 different samples of sheet stretched at various temperatures, strain rates and total strains.

FIG. 2-11 shall be discussed in the following to illustrate some important properties of the sheet stretched according to the invention. According to FIG. 2, a significant amount of work hardening occurs by stretching to a total strain of 6%, resulting in an increase of ultimate tensile strength from about 375 MPa of the unstretched reference to above 390 MPa for forming temperatures of −40 or −50° C. Yield strength increases from about 290 to above 350 MPa. Although the best results are achieved at about room temperature, this technique does not form an alternative, due to the clear appearance of PLC lines at these temperatures. It is furthermore evident from FIG. 2 that the work hardening effect is considerably higher at cryogenic temperatures than at temperatures above 100° C., thus cryo-stretching yields considerably better results in this regard.

Figure 3:
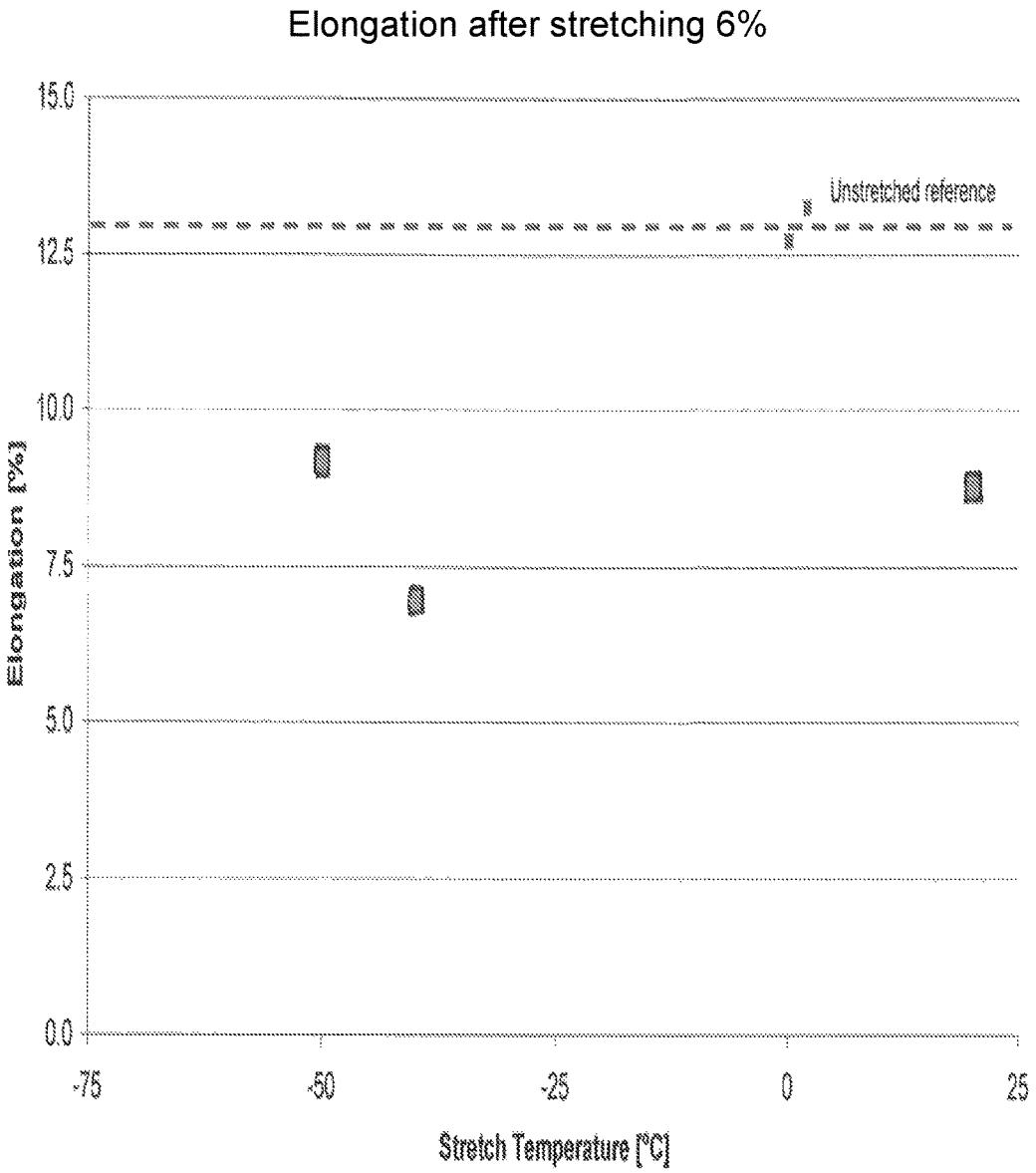
FIG. 3 is a diagram of elongation of different samples stretched to a total strain of 6% at different temperatures.

FIG. 3 shows values for the elongation after stretching by 6%, which appears to be fairly constant for temperatures between −50° C. and −100° C. This is of great advantage, since it demonstrates that the temperature need not be constant during stretch forming, but may vary by for example ±20° C., as long as the critical temperature for cryo-stretching is not overstepped.

Thus, one can summarise that the tensile properties yield strength, ultimate tensile strengths and elongation have very low temperature dependency, thus, there will be low inhomogeneous deformation when stretch forming is performed at inhomogeneous or varying temperature. Furthermore, the strain hardening increases with decreasing stretch forming temperature.

Figure 4:
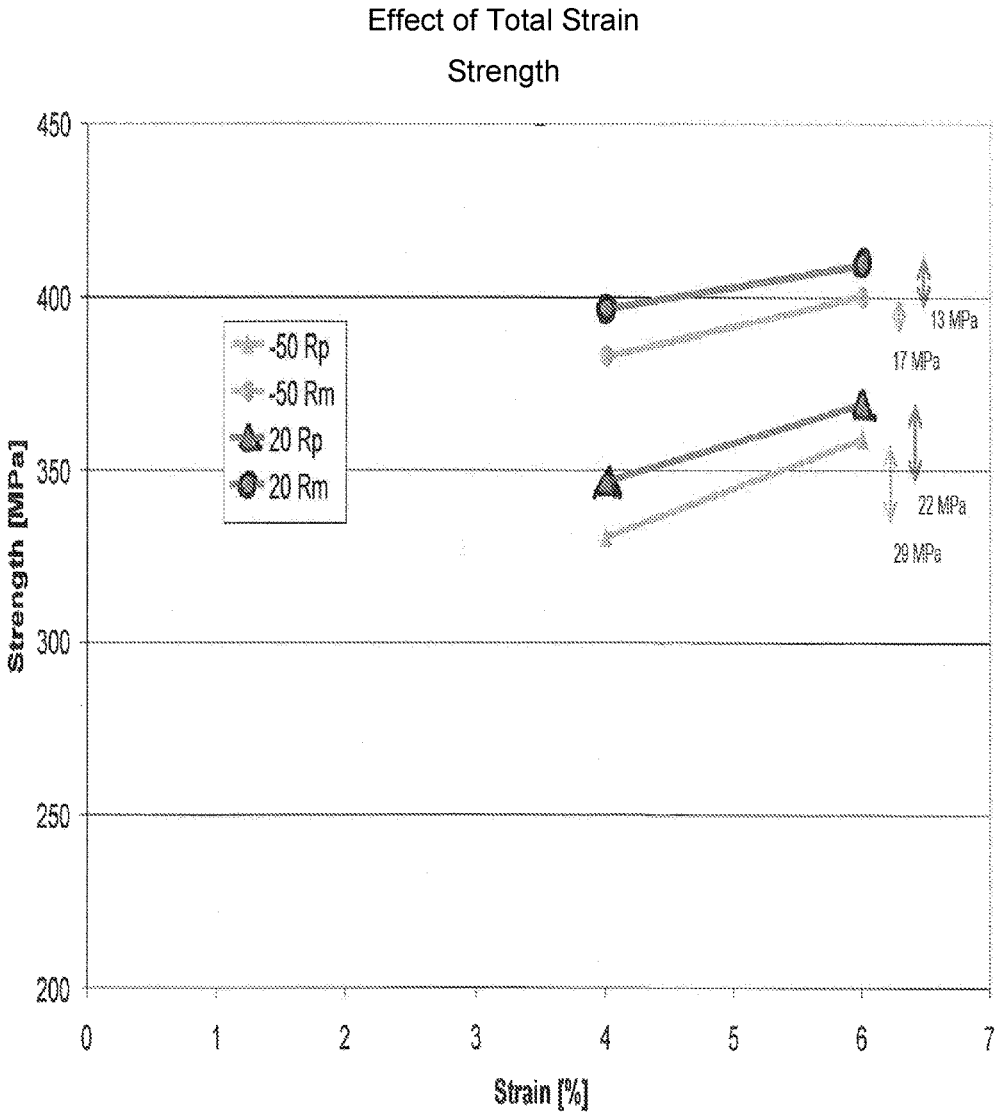
FIG. 4 is a diagram illustrating the effect of total strain on strength.
Figure 5:
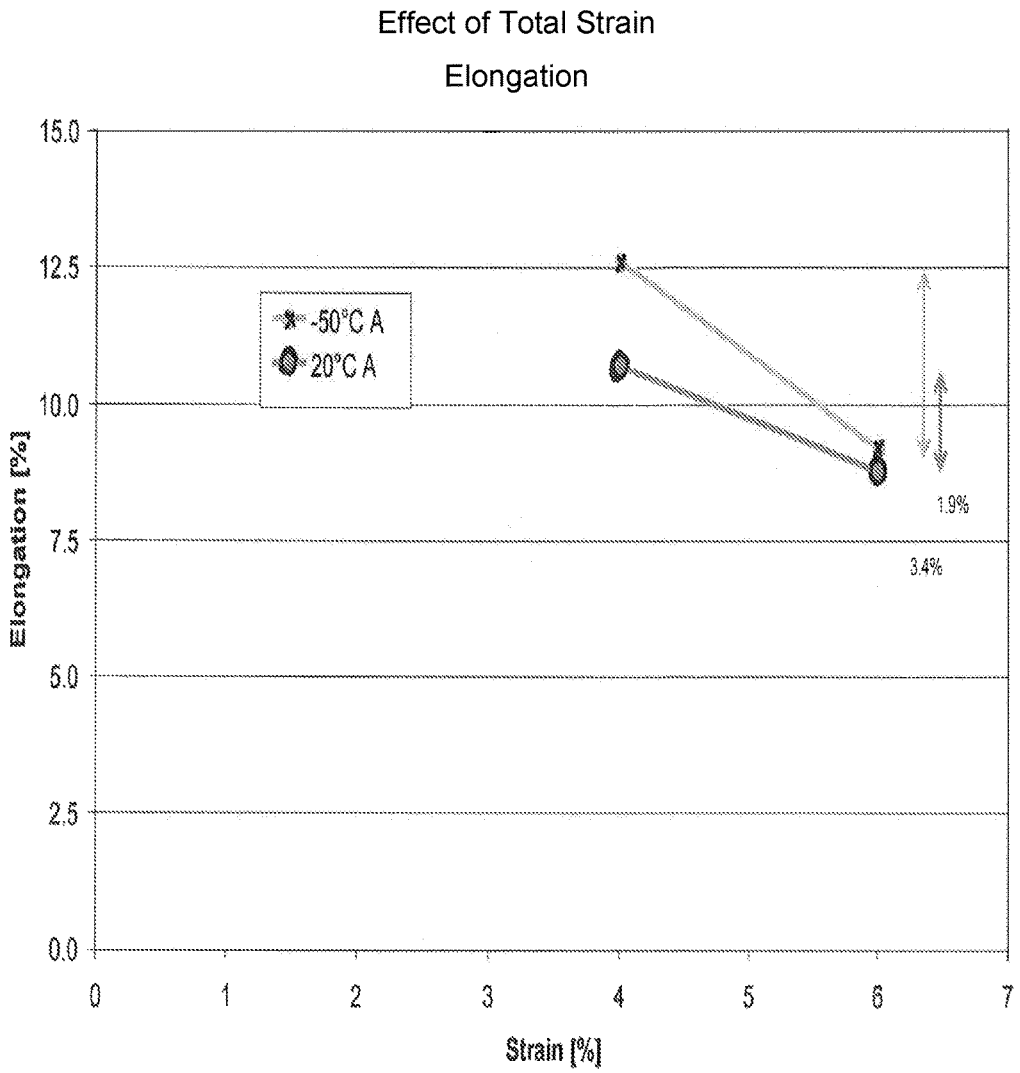
FIG. 5 is a diagram of elongation against total strain.
Figure 6:
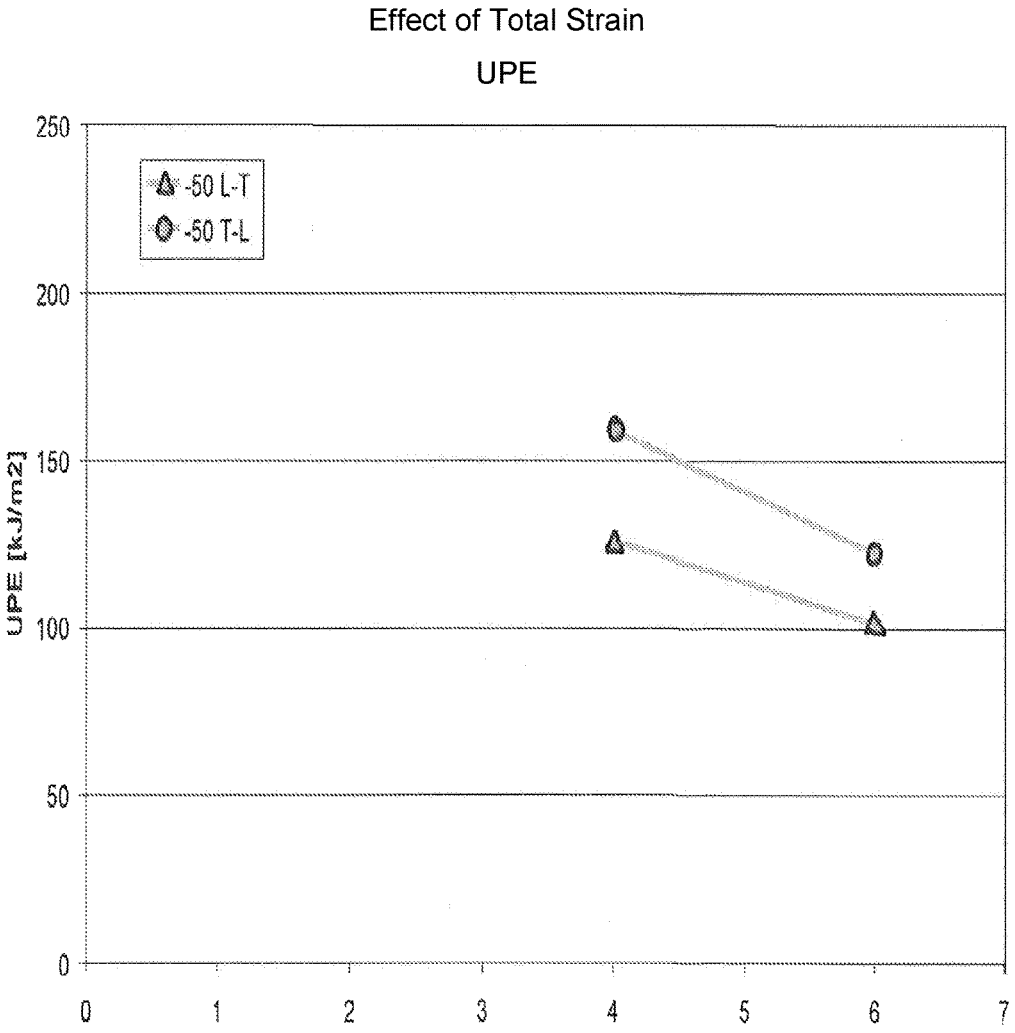
FIG. 6 is a diagram of unit propagation energy against total strain.

The effect of total strain on various properties will be discussed with reference to FIGS. 4-6. According to FIG. 4, an increase of the total strain from 4% to 6% results in an 8% increase in Rm and a 5% increase in Rp. This difference is quite small, which is also very good, allowing the technique to be applied for commercial panels which are not stretched by the same amount at every position. According to the invention, the variation of tensile properties across the formed panel will nevertheless be small.

Figure 7:
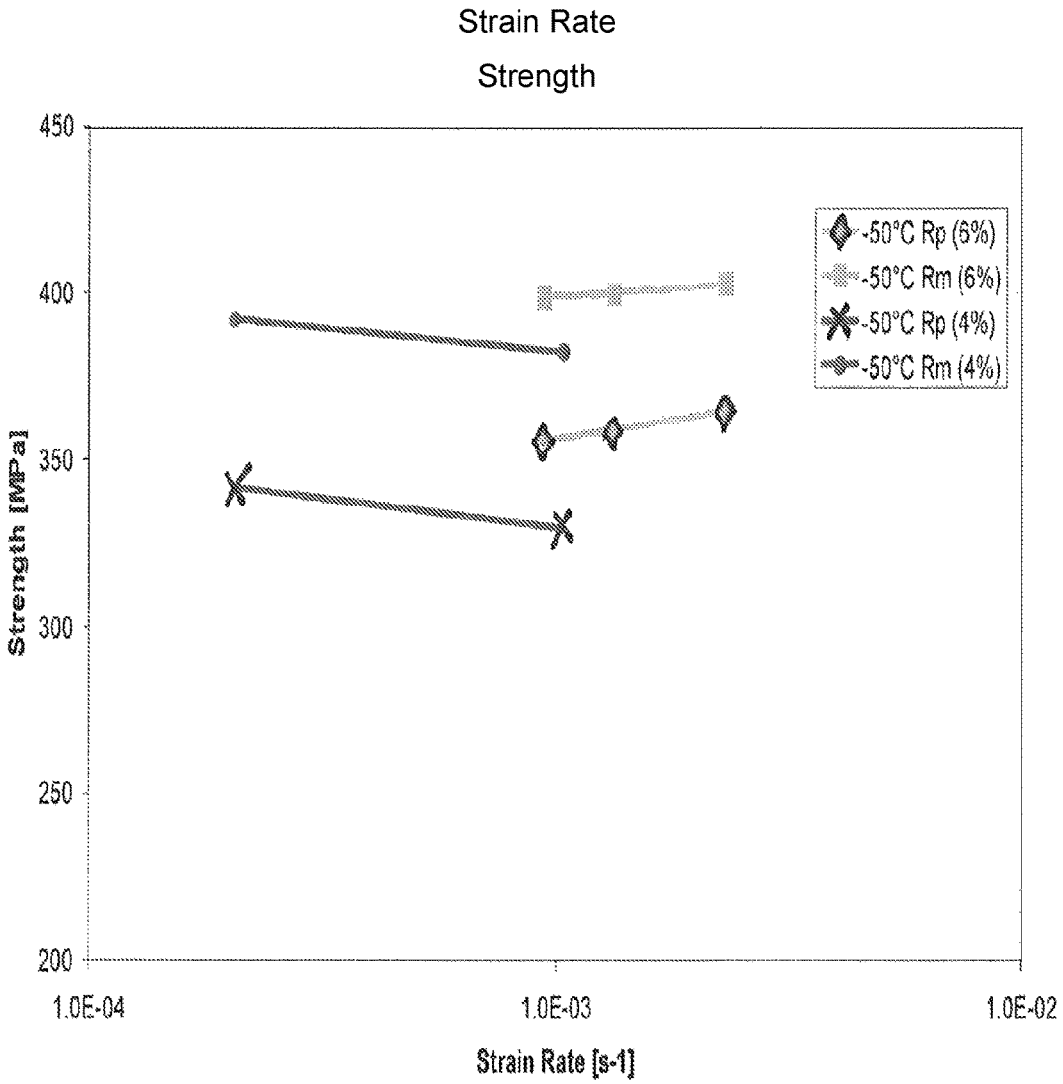
FIG. 7 is a diagram of strength against strain rate.
Figure 8:
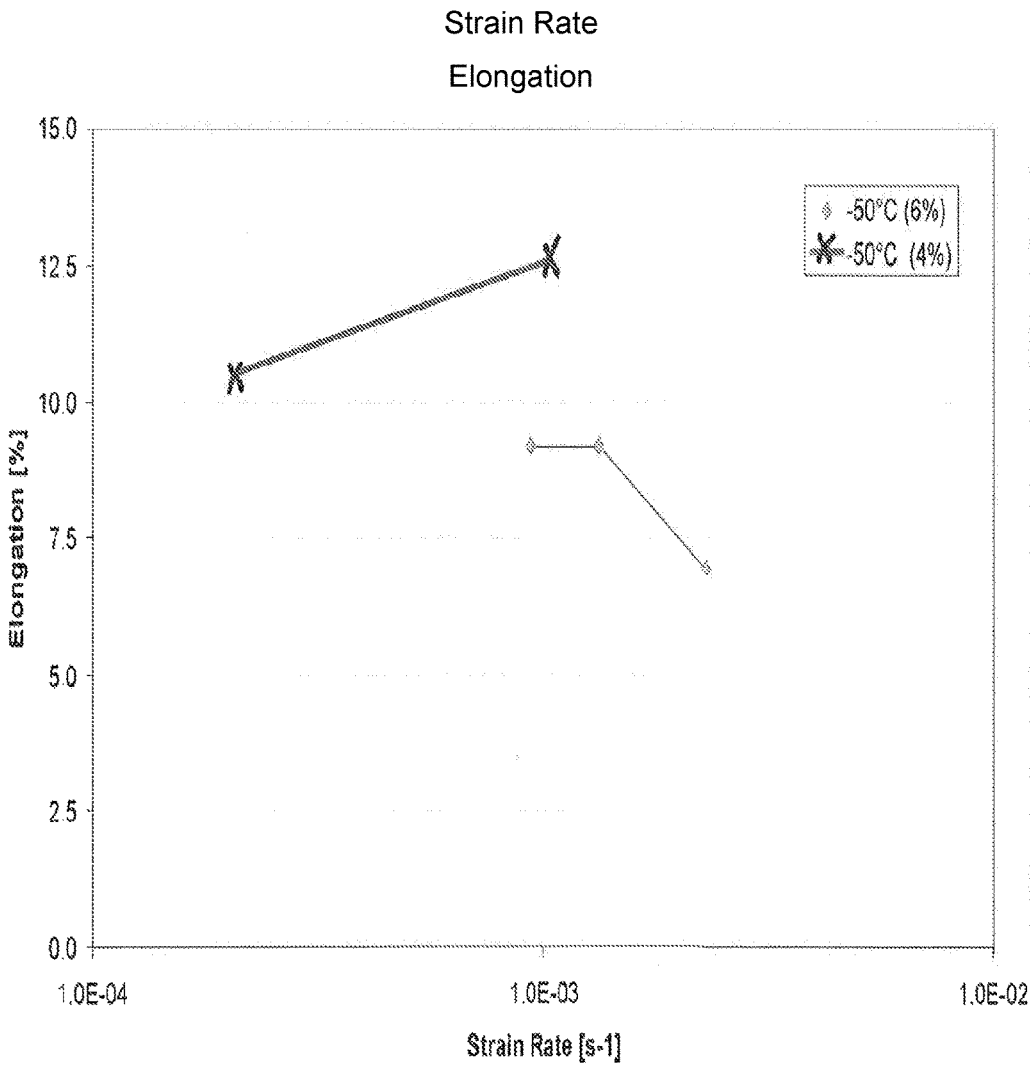
FIG. 8 is a diagram of elongation against strain rate.
Figure 9:
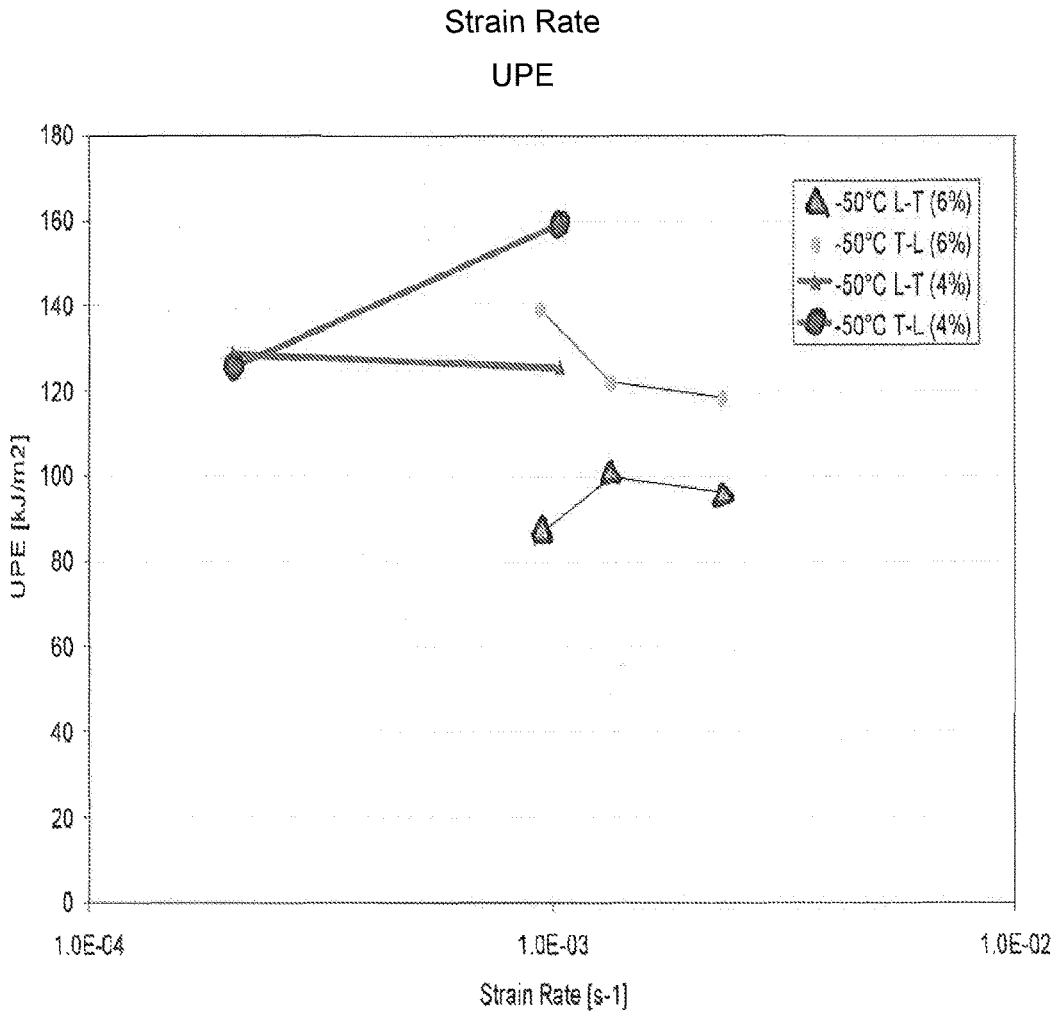
FIG. 9 is a diagram of unit propagation energy against a strain rate.

FIG. 7-9 demonstrate the effect of strain rate on various properties. As evident from FIG. 7, the effect on strength is generally very low. Elongation seems to decrease with increasing strain rate, whereas unit propagation energy appears to be relatively unaffected by the strain rate. Thus, there appears to be no obstacle to using a high strain rate, in order to achieve a relatively high critical temperature according to FIG. 1, and which also has the advantage of a high throughput of formed panels.

Figure 10:
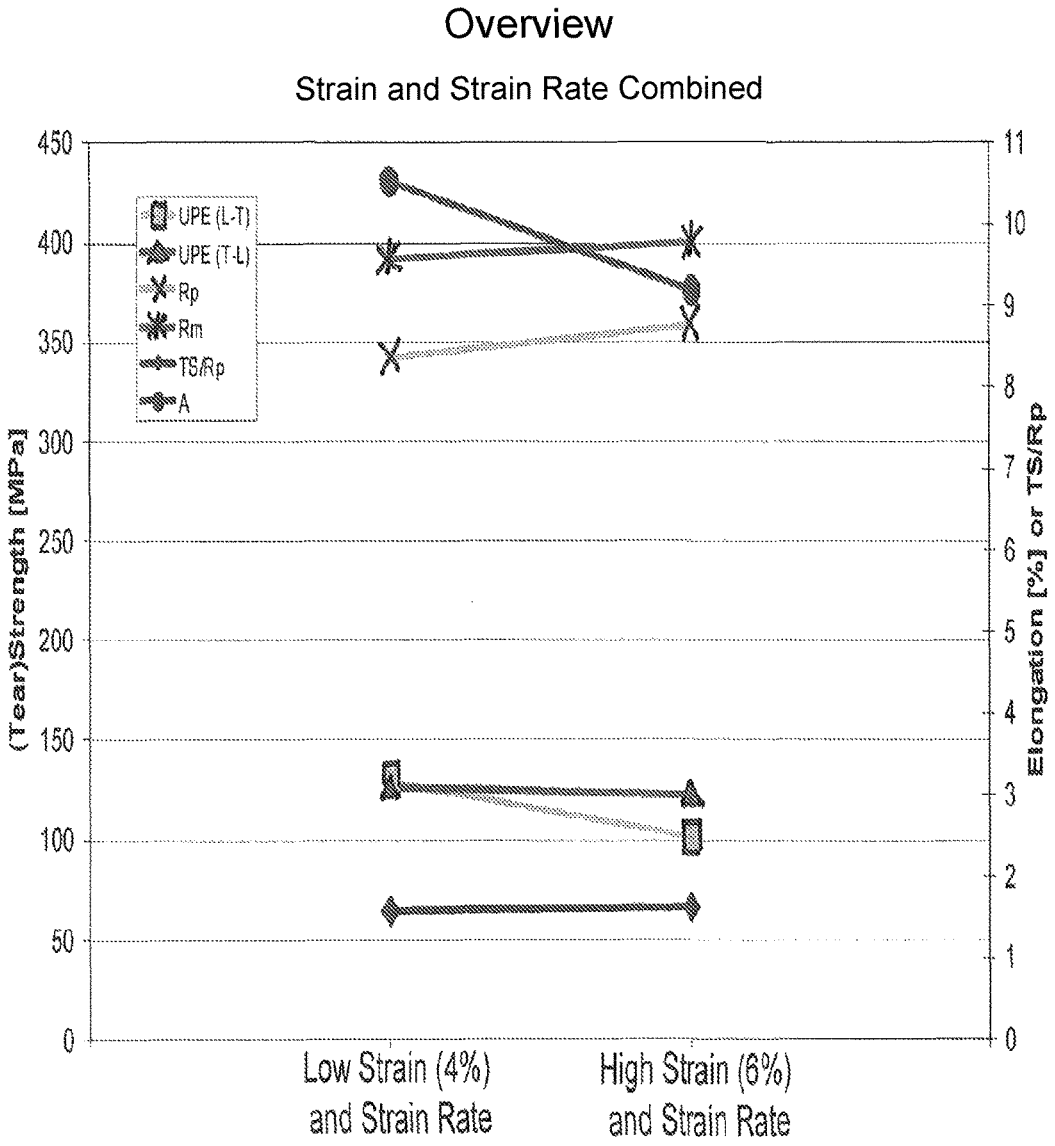
FIG. 10 is a diagram of various properties, compared for samples stretched at low strain and strain rate vs. high strain and strain rate.

FIG. 10 gives a summary of various properties, comparing a low strain (4%) and low strain rate with high strain (6%) and high strain rate at a temperature of −50° C. The diagram clearly shows that all properties remain relatively constant, which is a good indication for a homogeneous distribution of properties over a formed panel which is stretched by different amounts in different positions.

Figure 11:
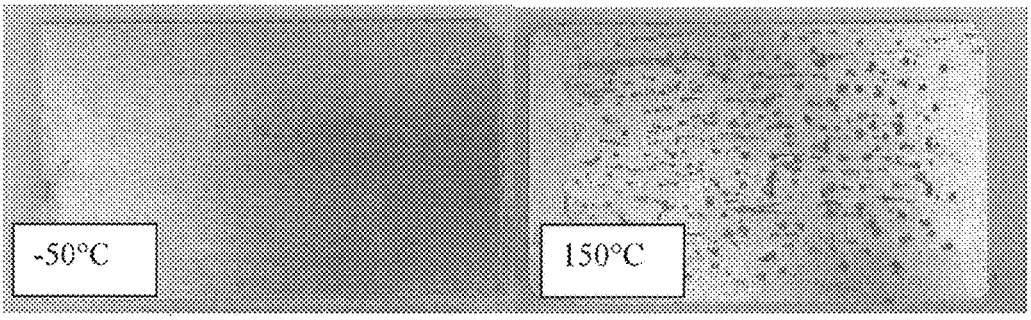
FIG. 11 are photographs of 5xxx sheet stretched at −50° C. (left) and 150° C. (right) tested for corrosion resistance according to ASTM G-66.

The invention has the additional advantage that cryo-stretching does not sensitize the material, therefore there will be no loss of corrosion resistance, see Table 3 and FIG. 11 in which the exfoliation and pitting corrosion for cryo-streched 5xxx sheet according to ASTM G-66 is compared with that of sheet stretched at +150° C. to prevent PLC lines. In Table 3, "PA" and "PB" stand for slight pitting and moderate pitting respectively, "PN" stands for no pitting, and "EA" stands for slight exfoliation. Because there is no recovery of the deformed microstructure, the strength values are retained. The strain hardening increases with decreasing stretch temperature.

TABLE 3

| Stretch Temperature | Degree of Exfoliation | Degree of Pitting/Pit-Blistering |
|---|---|---|
| −50° C. | EA | PN |
| +150° C. | EA | PB |

Having now fully described the invention, it will be apparent to one of ordinary skill in the art that many changes and modifications can be made without departing from the spirit or scope of the invention as herein described.

The invention claimed is:

1. A method of producing a shaped aluminium alloy panel from 5000-series aluminium alloy sheet, the method comprising:

providing a sheet made of 5000-series alloy having a thickness of about 0.05 to 10 mm and a length in a longest dimension of at least 800 mm; and stretch forming the sheet at a target forming temperature between −90° C. and −25° C., to obtain the shaped aluminium alloy panel, wherein the shaped aluminium alloy part is not showing any Portevin-Le-Chatelier (PLC) lines and has a tensile strength in L-T direction of above 350 MPa, and an elongation above 7%.

2. The method according to claim 1, wherein the target forming temperature is below a value $T_{crit}$ characterized by the formula $$T_{crit}[^\circ\text{ C.}]=\log_{10}(\acute{\epsilon}[s^{-1}])\times 18.8+13.8^\circ\text{ C.}$$

wherein $\acute{\epsilon}$ is the strain rate during forming.

3. The method according to claim 1, wherein the stretch forming is performed at a strain rate between 0.1 and $10^{-4}$ $s^{-1}$.

4. The method according to claim 3, wherein the sheet is made of a Sc-containing aluminium alloy having Sc in a range, in weight percent, of 0.05% to 1%.

5. The method according to claim 1, wherein the strain rate is above $1\times10^{-3}$ $s^{-1}$.

6. The method according to claim 1, wherein the sheet is stretched, at least in some positions, by a total strain of 1 to 8%.

7. The method according to claim 1, wherein the target forming temperature is between −90° C. and −40° C.

8. The method according to claim 1, wherein the temperature during forming is held constant to within ±10° C. of the target forming temperature, during the stretch forming.

9. The method according to claim 1, wherein the sheet is cooled down prior to the stretch forming by use of dry ice and no further cooling is done during the stretch forming.

10. The method according to claim 9, where the sheet is cooled down by immersion in or spraying with the dry ice.

11. The method according to claim 1, wherein the sheet made of 5000-series alloy has been produced by casting an ingot;

hot rolling;

cold rolling;

annealing.

12. The method according to claim 1, comprising a step of annealing the shaped aluminium alloy panel at a temperature of 250-350° C., or of inter-annealing the aluminium alloy panel between two stretch forming steps at a temperature of 250-350° C.

13. The method according to claim 1, wherein the aluminium alloy panel is for aerospace or automotive applications.

14. The method according to claim 1, wherein the strain rate is above $2\times10^{-3}$ $s^{-1}$.

15. The method according to claim 1, wherein the sheet is stretched, at least in some positions, by a total strain between 3% and 8%.

16. The method according to claim 1, wherein the sheet is stretched, at least in some positions, by a total strain between 3.5% and 6.5%.

17. The method according to claim 1, wherein the target forming temperature is between −90° C. and −50° C.

18. The method according to claim 1, wherein the temperature during forming is held constant to within ±15° C. of the target forming temperature, during the stretch forming.

19. The method according to claim 1, wherein the sheet made of 5000-series alloy has been produced by casting an ingot;

hot rolling;

cold rolling;

annealing for 1-2 hours at 270-280° C.

20. The method of claim 1, wherein the sheet is made of a 5000-series alloy having a thickness of about 0.05 to 10 mm and a length in the longest dimension of at least 800 mm.

21. The method of claim 1, wherein the sheet is made of a 5000-series alloy having a thickness of about 0.6 to 6 mm, and a length in the longest dimension of at least 800 mm.

22. The method according to claim 1, wherein the sheet is made of a Sc-containing aluminium alloy having Sc in a range, in weight percent, of 0.05% to 1%.

23. The method according to claim 22, wherein the sheet is made from Sc-containing aluminium alloy comprising, in weight %, 3.0-6.0% Mg,
0.05-0.5% Sc,
0.05-0.25% Zr,
optionally up to 2% Zn,
balance is made by Fe, Si, regular impurities and aluminium.

24. The method according to claim 22, wherein the sheet is made from Sc-containing aluminium alloy comprising, in weight %, 3.8-5.3% Mg,
0.10-0.15% Zr,
optionally up to 2% Zn,
balance is made by Fe, Si, regular impurities and aluminium.

25. The method according to claim 1, wherein the sheet is made from an aluminium alloy of the AA5024-series.

26. The method according to claim 1, wherein the target forming temperature is between −80° C. and −40° C.

27. The method according to claim 26, wherein the target forming temperature is between −70° C. and −40° C.

* * * * *